US005702266A

United States Patent [19]

Jones

[11] Patent Number: 5,702,266

[45] Date of Patent: Dec. 30, 1997

[54] ELECTRICAL CONNECTOR LATCHING SYSTEM

[75] Inventor: Dennis Boyd Jones, Tustin, Calif.

[73] Assignee: Molex Incorporated, Lisle, Ill.

[21] Appl. No.: 646,733

[22] Filed: May 3, 1996

[51] Int. Cl.[6] ..... H01R 13/627

[52] U.S. Cl. ..... 439/357; 439/352; 439/953

[58] Field of Search ..... 439/357, 358, 439/372, 953, 352

[56] References Cited

U.S. PATENT DOCUMENTS

| | | | |
|---|---|---|---|
| 4,678,256 | 7/1987 | Nishino et al. | 439/347 |
| 4,838,810 | 6/1989 | Yoshimura et al. | 439/358 |
| 4,842,542 | 6/1989 | Davis | 439/357 |
| 5,009,616 | 4/1991 | Fogg et al. | 439/608 |
| 5,154,629 | 10/1992 | Carver et al. | 439/352 |
| 5,234,350 | 8/1993 | Marechal et al. | 439/139 |
| 5,340,329 | 8/1994 | Hirai | 439/357 |
| 5,411,415 | 5/1995 | Embo et al. | 439/610 |
| 5,486,117 | 1/1996 | Chang | 439/357 |

*Primary Examiner*—P. Austin Bradley
*Assistant Examiner*—Yong Ki Kim
*Attorney, Agent, or Firm*—Stacey E. Caldwell; James C. Paschall

[57] ABSTRACT

A latching system for a mating electrical connector assembly includes a shell having a forward connecting section for connection with a complementary connector in a mating direction. A latch member extends in the mating direction and includes a latch end movable between a latch position in latching engagement with a latching surface on the complementary connector and a release position disconnected from the complementary connector. The latch member includes an actuator end for moving the latch end. A housing of resilient dielectric material is overmolded about portions of the shell and the latch member and includes an integrally molded actuator button for engaging and moving the actuator end of the latch member and, in turn, moving the latch end of the latch member to its release position. The latch member extends axially through a ferrule and is pivotally mounted therewithin. A resilient O-ring is mounted within the ferrule to bias the latch member in its latch position.

14 Claims, 3 Drawing Sheets

ELECTRICAL CONNECTOR LATCHING SYSTEM

FIELD OF THE INVENTION

This invention generally relates to the art of electrical connectors and, particularly, to a system for latching an electrical connector with a complementary electrical connector or other connecting device.

BACKGROUND OF THE INVENTION

In mating electrical connector systems, it often is important to lock or latch two mating connectors to one another for ensuring proper and complete interconnection of the connector terminals and to further ensure ongoing connection of the connectors. This is particularly critical in environments where the connector assembly is subject to vibration or movement or low insertion and/or withdrawal forces where the connectors may become unintentionally or inadvertently disconnected. Unfortunately, durable latching systems such as screws or bolts or other labor-intensive systems can be expensive in terms of component and assembly costs. Less expensive latches, such as integrally molded plastic systems, often are inadequate for connector systems intended for repeated cycling.

A known type of latching system is a "quick release" latching system which includes thumb or finger actuators which, when depressed, allow for low or zero force unmating of the connectors. Such systems may provide an "audible click" to indicate complete mating of the two connectors. However, these latching systems can be expensive since the mechanisms generally require a number of components most or all which are typically fabricated of metallic components.

A latching system with relatively few components, requiring fewer points of attachment and resulting in less wear and less associated assembly and component costs would be mechanically and economically desirable. Such a latching system should have as few components as possible, each possessing good individual wear characteristics.

The invention is directed to solving the myriad of problems discussed above in a latching system for an electrical connector which requires as few components as is possible.

SUMMARY OF THE INVENTION

An object, therefore, of the invention is to provide a new and improved latching system for an electrical connector of the character described.

In the exemplary embodiment of the invention, an electrical connector includes a shell having a forward connecting section for connection with a complementary connector in a mating direction. A latch member extends in the mating direction and includes a latch end movable between a latch position in latching engagement with a latching surface on the complementary connector and a release position disconnected from the complementary connector. The latch member includes an actuator end for moving the latch end. A housing of resilient dielectric material is overmolded about portions of the shell and the latch member and includes an integrally molded actuator button for engaging and moving the actuator end of the latch member and, in turn, moving the latch end of the latch member to its release position.

As disclosed herein, the latch member includes a fulcrum about which the latch end and the actuator end are pivotally movable. Specifically, the latch member extends axially through a ferrule, and a pivot pin extends transversely through the ferrule and pivotally mounts the latch member.

An O-ring is mounted within the ferrule and provides a spring means for biasing the latch member toward its latch position. Preferably, the latch member is generally planar, and the pivot pin extends through the latch member generally perpendicular to the plane thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
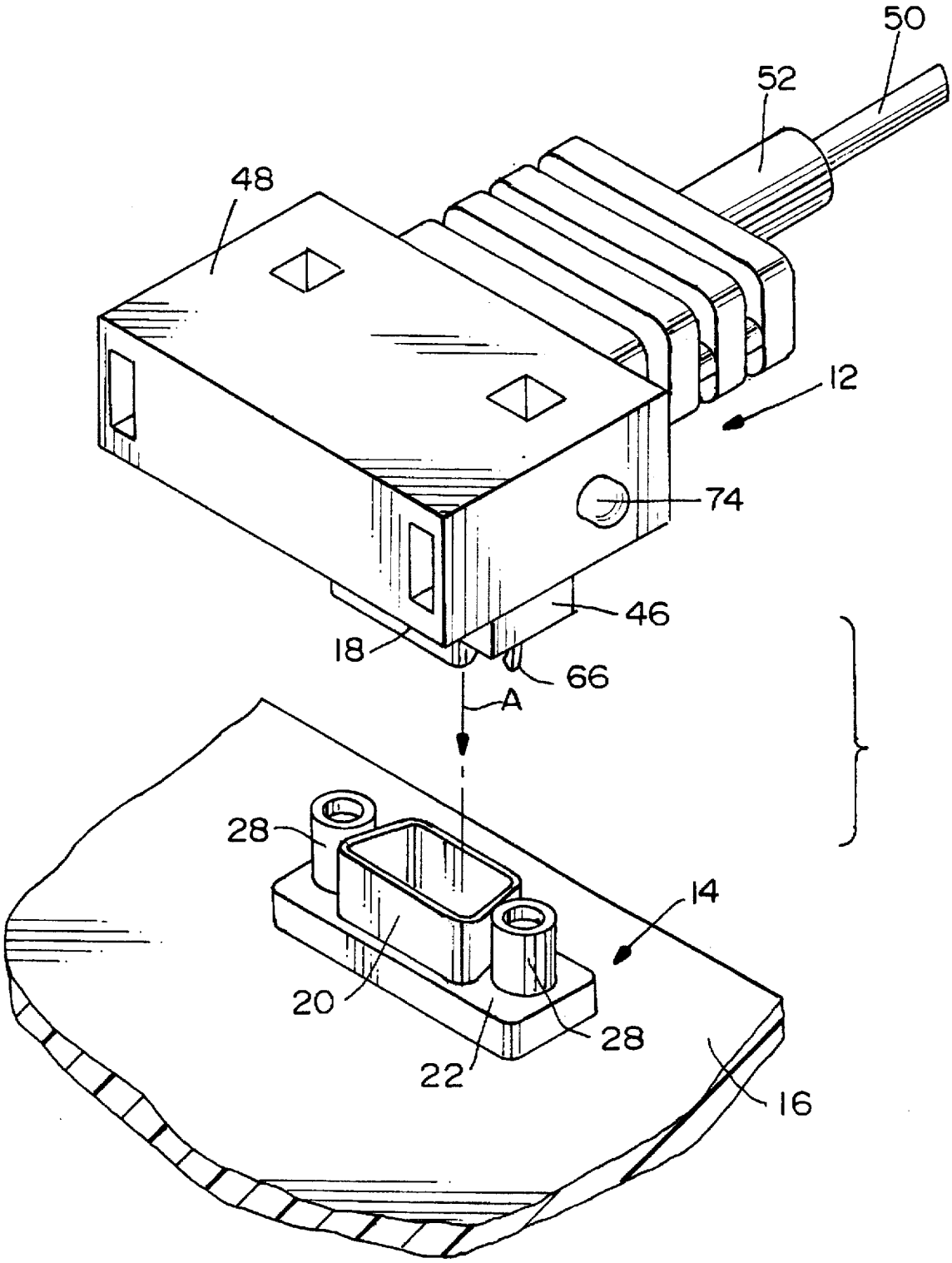
FIG. 1 is an exploded perspective view of an electrical connector assembly embodying the latching system of the invention.

Referring to the drawings in greater detail, and first to FIG. 1, the invention is embodied in an electrical connector assembly, generally designated 10, which includes a first or plug connector, generally designated 12, and a complementary or socket connector, generally designated 14. The socket connector is mounted on a printed circuit board 16, and plug connector 12 is mateable with the socket connector in a mating direction indicated by arrow "A". Plug connector 12 includes a D-shaped connecting section or plug 18 which is inserted into a D-shaped connecting section or socket 20 of socket connector 14, as is known in the art. Both connectors house complementary interengaging electrical terminals (not shown), as is also known in the art.

Socket connector 14 includes a metal base or flange 22 integrally die-cast with connector section or socket 20. A pair of metal guide ferrules 28 are disposed at opposite ends of socket 20 and project from base 22 toward mating plug connector 12.

Figure 2:
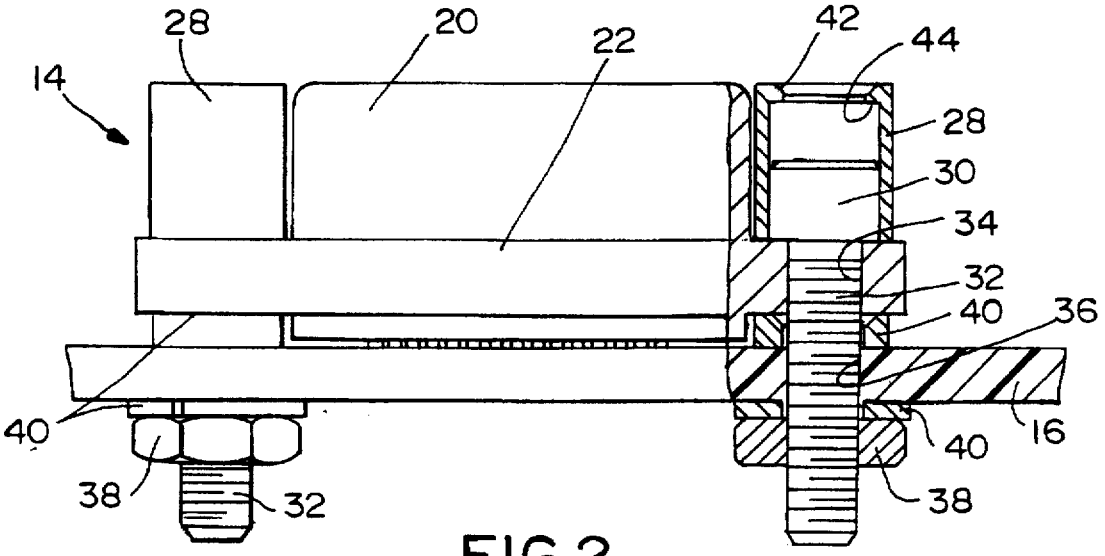
FIG. 2 is a side elevational view, partially cut away and in section, of the plug connector of the invention mounted on a printed circuit board.

Referring to FIG. 2 in conjunction with FIG. 1, socket connector 14 is secured to printed circuit board 16 by a pair of bolts having enlarged head portions 30 press-fit within the bottoms of guide ferrules 28. The bolts have externally threaded shank portions 32 which extend through holes 34 in flange 22 and holes 36 in printed circuit board 16, with internally threaded nuts 38 threaded onto the distal ends of the shanks to lock the connector to the board. The threaded shank 32 of each bolt extends through a pair of washers which sandwich and protect the printed circuit board. Lastly, FIG. 2 shows that each guide ferrule 28 has an inwardly directed, circumferential flange 42 within the upper open end thereof. This flange defines a downwardly or inwardly facing latch shoulder 44 for purposes described hereinafter.

Figure 3:
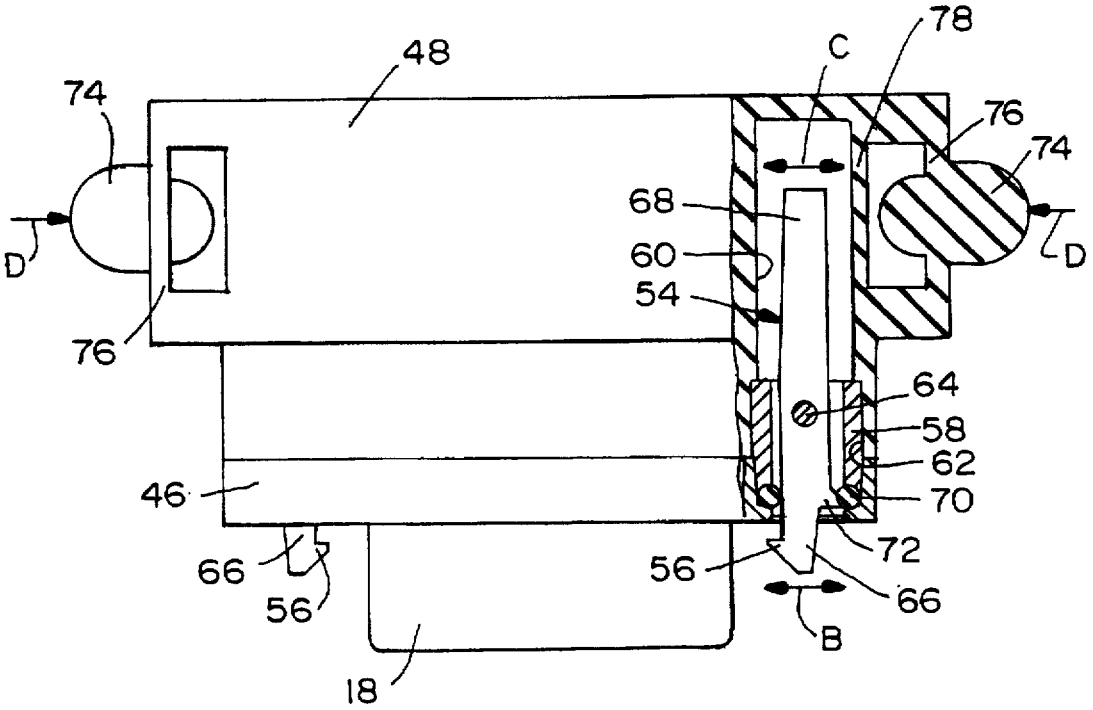
FIG. 3 is a side elevational view, partially cut away and in section, of the socket connector of the invention which mates with the plug connector.

Referring to FIG. 3 in conjunction with FIG. 1, plug connector 12 includes a metal shell 46 integrally die-cast with forward connecting section or plug 18. A housing 48 of resilient dielectric material is overmolded substantially about shell 46 and the terminating end of an electrical cable 50 which includes wires or conductors terminated to the terminals within plug connector 12. The overmolded housing may include an integrally molded strain-relief boot 52 (FIG. 1) projecting rearwardly about cable 50. A pair of latch members, generally designated 54 (FIG. 3), extend in mating direction "A" along opposite sides of plug connector 12 and connecting section or plug 18. Each latch member 54 has a latch hook 56 for latchingly engaging behind the latch shoulder 44 within one of the guide ferrules 28 of socket connector 14, as will be seen in detail hereinafter.

Referring specifically to FIG. 3, each latch member 54 extends axially through a metal ferrule 58 within a passage 60 formed within overmolded housing 48 and a passage 62 in die-cast shell 46. The latch member is generally planar, as being stamped from sheet metal material. The latch member is pivotally mounted within ferrule 58 by means of a pivot pin 64 extending transversely through the ferrule and pivotally mounting the latch member. Therefore, the latch member has a free latch end 66 movable about pivot pin 64 in the direction of double-headed arrow "B", and a free actuator end 68 pivotally movable about pivot pin 64 in the direction of arrow "C". Latch end 66 and latch hook 56 are movable between a latch position and a release position, as will be described in greater detail hereinafter.

Generally, spring means in the form of a resilient O-ring are provided for biasing each latch member 54 toward its latch position. More particularly, and still referring to FIG. 3, the O-ring 70 is sandwiched between one end of metal ferrule 58 and portions of shell 46 within passage 62. Latch member 54 has a tab 72 projecting transversely outwardly into engagement with the resilient O-ring. FIG. 3 shows the latch member in its latch position. When the latch member is moved to its release position (shown hereinafter), tab 72 compresses resilient O-ring 70, and the O-ring will bias the latch member back to its latch position when the latch member is released.

Still referring to FIG. 3, resilient overmolded dielectric housing 48 includes a pair of integrally molded actuator buttons 74 which are effective to move latch members 54 from their latch positions to their release positions when the push buttons are depressed in the direction of arrows "D", as by an operator pinching the housing at the actuator buttons between the operator's thumb and forefinger. Movement of the actuator buttons is facilitated by forming the buttons as part of a thin web portion 76 of the overmolded housing, and including a thin resilient diaphragm portion 78 disposed between each actuator button and actuator end 68 of the respective latch member.

Figure 4:
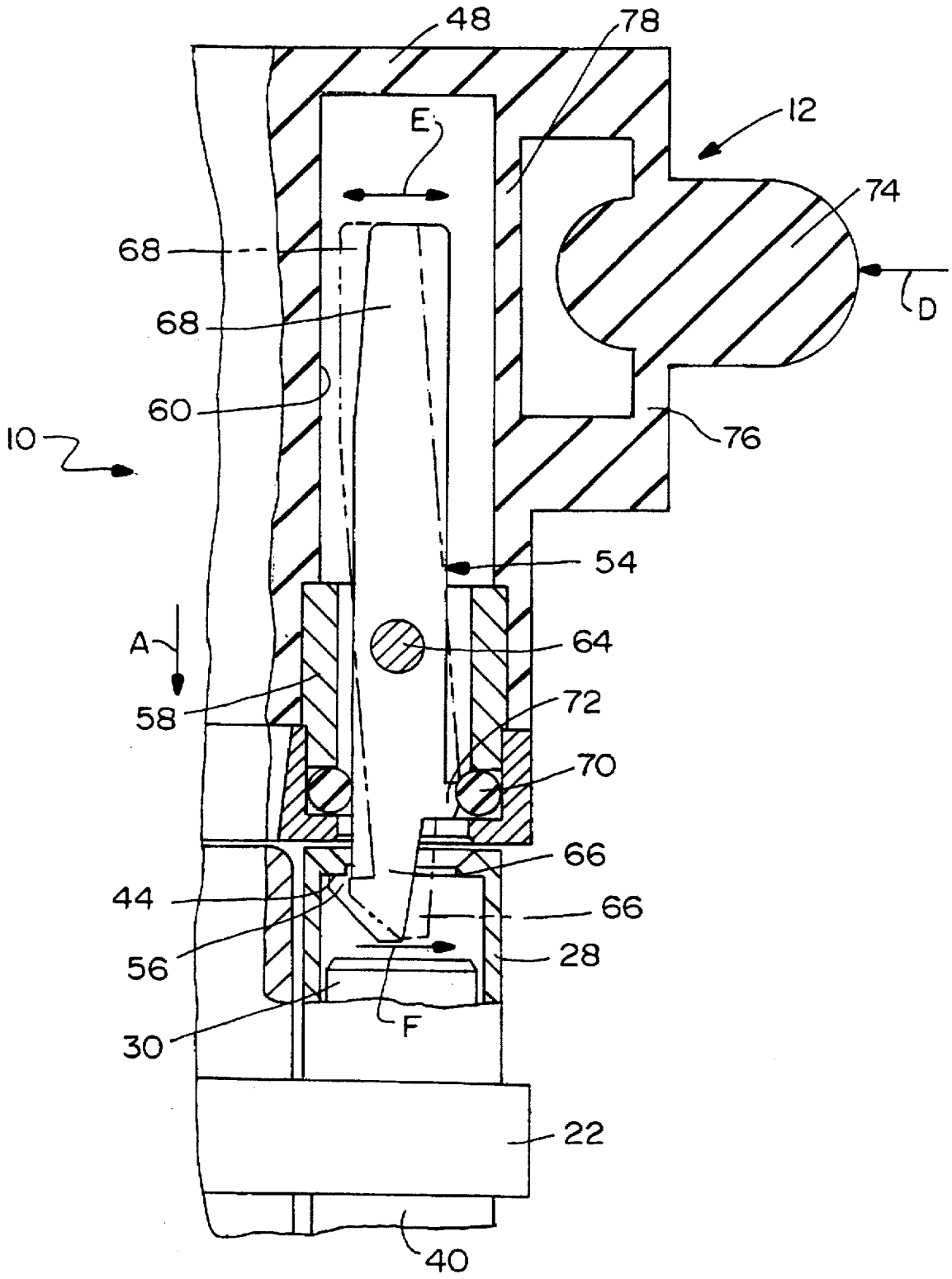
FIG. 4 is a fragmented view through the latch mechanism, with the connectors fully mated.

FIG. 4 shows plug connector 12 fully mated with socket connector 14, and with one of the latch members 54 shown in full lines in its latch position. In the latch position of the latch member, it can be seen that latch hook 56 at the free latch end 66 of the latch member is in latching engagement with latch surface 44 of guide ferrule 28 of socket connector 14. Resilient O-ring 70 is effective to bias and maintain the latch member in its latch position as shown in full lines in FIG. 4.

When it is desired to move latch member 54 (FIG. 4) to its release position, actuator button 74 is pushed inwardly in the direction of arrow "D", whereupon the latch button will engage diaphragm portion 78 of the housing which, in turn, will engage actuator end 68 of the latch member and pivot the actuator end about pivot pin 64 in the direction of arrow "E". This pivots latch end 66 and latch hook 56 in the direction of arrow "F" to its release position wherein latch hook 56 is clear of latch surface 44 in the mating direction "A" of the connectors. This release position of latch member 54 is shown in phantom in FIG. 4. With the actuator buttons 74 depressed, thereby moving the latch members to their release positions, the connectors now can be unmated or disconnected opposite the mating direction indicated by arrow "A", as latch ends 66 and latch hooks 56 of the latch members freely move out of guide ferrules 28 of socket connector 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a shell having a forward connecting section for connection with a complementary connector in a mating direction;

a latch member extending in said mating direction and including a latch end pivotable between a latch position in latching engagement with a latching surface on the complementary connector and a release position disconnected from the complementary connector, and an actuator end for moving the latch end; and a housing of resilient dielectric material overmolded about portions of the shell and the latch member and including an integrally molded actuator portion disengaged from the actuator end of the latch member when the latch end is in the latch position, said actuator portion for engaging and moving the actuator end of the latch member and, in turn, moving the latch end of the latch member to its release position.

2. The electrical connector of claim 1 wherein said latch member extends axially through a ferrule and including a pivot pin extending transversely through the ferrule and pivotally mounting the latch member.

3. The electrical connector of claim 1, including means for biasing the latch member in its latch position.

4. The electrical connector of claim 3 wherein said means for biasing comprises a resilient O-ring surrounding the latch member.

5. The electrical connector of claim 4 wherein said latch member extends through a ferrule, and said O-ring is mounted within the ferrule.

6. The electrical connector of claim 1 wherein said latch member comprises a substantially planar member pivotally mounted on a pivot member extending generally perpendicular to the plane of the latch member.

7. An electrical connector, comprising:

a shell having a forward connecting section for connection with a complementary connector in a mating direction;

a ferrule mounted on said shell and extending in said mating direction; and a latch member extending in said mating direction and including a latch end movable between a latch position in latching engagement with a latching surface on the complementary connector and a release position disconnected from the complementary connector, and an actuator end for moving the latch end, the latch member extending axially through said ferrule and including a pivot pin extending transversely through the ferrule and pivotally mounting the latch member.

8. The electrical connector of claim 7 wherein said latch member comprises a substantially planar metal member with said pivot pin extending therethrough generally perpendicular to the plane of the latch member.

9. The electrical connector of claim 8, including an O-ring mounted within the ferrule for biasing the latch member toward its latch position.

10. An electrical connector, comprising:

a shell having a forward connecting section for connection with a complementary connector;

a latch member pivotable about a fulcrum between a latch position in latching engagement with a latching surface on the complementary connector and a release position disconnected from the complementary connector;

a housing of resilient dielectric material overmolded about portions of the shell and the latch member and including an integrally molded actuator portion for engaging and moving the latch member to its release position; and a rigid tab extending from said latch member toward engagement with a resilient portion of said connector for biasing the latch member toward the latch position.

11. The electrical connector of claim 10 wherein said latch member extends axially through a ferrule, and including a pivot pin extending transversely through the ferrule to pivotally mount the latch member.

12. The electrical connector of claim 10 wherein said latch member extends through a ferrule and said resilient portion for biasing the latch member comprises a resilient O-ring mounted within the ferrule.

13. An electrical connector, comprising:

a housing;

a latch member mounted on the housing for movement between a latch position in latching engagement with a latching surface on a complementary connector and a release position disconnected from the complementary connector; and a resilient O-ring fixed relative to the housing and surrounding a movable portion of the latch member for biasing the latch member in its latch position.

14. The electrical connector of claim 13 wherein a tab projects from said latch member and engages the O-ring.

* * * * *